US009662913B2

(12) United States Patent
Tanabe et al.

(10) Patent No.: US 9,662,913 B2
(45) Date of Patent: May 30, 2017

(54) PRINTING APPARATUS

(71) Applicant: SEIKO EPSON CORPORATION, Tokyo (JP)

(72) Inventors: Kentaro Tanabe, Nagano (JP); Kenji Kojima, Nagano (JP); Masaru Jingushi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/183,998

(22) Filed: Jun. 16, 2016

(65) Prior Publication Data

US 2017/0008319 A1 Jan. 12, 2017

(30) Foreign Application Priority Data

Jul. 10, 2015 (JP) ..... 2015-138482

(51) Int. Cl.
*B41J 11/00* (2006.01)
*B41J 15/04* (2006.01)
(Continued)

(52) U.S. Cl.
CPC ..... *B41J 15/048* (2013.01); *B41J 2/21* (2013.01); *B41J 3/4078* (2013.01); *B41J 11/007* (2013.01); *B41J 11/42* (2013.01); *B41J 17/02* (2013.01)

(58) Field of Classification Search
CPC ... B41J 2/21; B41J 11/007; B41J 11/42; B41J 15/048; B41J 11/46; B41J 17/02; G05B 2219/41184
See application file for complete search history.

(56) References Cited

U.S. PATENT DOCUMENTS 6,327,453 B1 * 12/2001 Imaizumi ..... G03G 15/0194 399/301
7,499,667 B2 * 3/2009 Matsuda ..... G03G 15/0131 399/302
(Continued)

FOREIGN PATENT DOCUMENTS

JP 5323631 B 10/2013
JP 5332884 B 11/2013
(Continued)

OTHER PUBLICATIONS

The Extended European Search Report for the corresponding European Application No. 16178101.8 dated Feb. 2, 2017.

*Primary Examiner* — Anh T. N. Vo
(74) *Attorney, Agent, or Firm* — Global IP Counselors, LLP

(57) ABSTRACT

A printing apparatus includes a belt mover for an endless belt that transports a recording medium, a feed amount calculator that calculates an amount of feed of the belt mover, a movement amount detection sensor as a movement amount measurer that measures actual amount of movement of the endless belt by image processing, a compensation table storer that stores a compensation table for compensating a transport error of the endless belt, and a control portion that calculates the amount of feed that is to bring about a predetermined amount of movement of the endless belt by using the feed amount calculator and by referring to the compensation table storer, moves the endless belt by using the belt mover on the basis of the amount of feed, compares the actual amount of movement of the endless belt measured by the movement amount detection sensor and the predetermined amount of movement.

3 Claims, 9 Drawing Sheets

(51) Int. Cl.

| | |
|---|---|
| ***B41J 2/21*** | (2006.01) |
| ***B41J 17/02*** | (2006.01) |
| ***B41J 3/407*** | (2006.01) |
| ***B41J 11/42*** | (2006.01) |

(56) References Cited

U.S. PATENT DOCUMENTS

| | | | | |
|---|---|---|---|---|
| 7,905,346 | B2 * | 3/2011 | Enomoto | B41J 11/007 198/807 |
| 8,246,140 | B2 | 8/2012 | Maekawara et al. | |
| 8,351,830 | B2 * | 1/2013 | Kudo | B65G 39/16 198/810.03 |
| 8,641,165 | B2 | 2/2014 | Shimizu et al. | |
| 9,141,016 | B2 * | 9/2015 | Watanabe | G03G 13/22 |
| 2017/0015118 | A1 | 1/2017 | Tanabe et al. | |

FOREIGN PATENT DOCUMENTS

| | | | |
|---|---|---|---|
| JP | 2017-024206 | A | 2/2017 |
| WO | 2013/146205 | A1 | 10/2013 |

* cited by examiner

| ANGLE θ (°) | | REFERENCE AMOUNT OF MOVEMENT Kn (mm) | | | |
|---|---|---|---|---|---|
| | | GREATER THAN OR EQUAL TO 0 | GREATER THAN OR EQUAL TO 8 | GREATER THAN OR EQUAL TO 16 | ··· |
| GREATER THAN OR EQUAL TO | LESS THAN | LESS THAN 8 | LESS THAN 16 | LESS THAN 24 | ··· |
| 0 | 30 | α = 0.023 | α = -0.026 | α = 0.037 | ··· |
| 30 | 60 | α = -0.018 | α = 0.046 | α = 0.031 | ··· |
| ⋮ | ⋮ | ⋮ | ⋮ | ⋮ | ··· ··· ··· |
| 330 | 360 | α = 0.042 | α = -0.033 | α = -0.029 | ··· |

FIG. 8

| BELT PHASE D (mm) | | REFERENCE AMOUNT OF MOVEMENT Kn (mm) | | | |
|---|---|---|---|---|---|
| | | GREATER THAN OR EQUAL TO 0 | GREATER THAN OR EQUAL TO 8 | GREATER THAN OR EQUAL TO 16 | ... |
| GREATER THAN OR EQUAL TO | LESS THAN | LESS THAN 8 | LESS THAN 16 | LESS THAN 24 | ... |
| 0 | 10 | δ = -0.078 | δ = -0.082 | δ = -0.067 | ... |
| 10 | 20 | δ = -0.143 | δ = -0.146 | δ = -0.161 | ... |
| ⋮ | ⋮ | ⋮ | ⋮ | ⋮ | ... ... ... |
| 4490 | 4500 | δ = 0.042 | δ = 0.064 | δ = 0.055 | ... |

PRINTING APPARATUS

BACKGROUND

1. Technical Field

The present invention relates to a printing apparatus.

2. Related Art

In recent years, the textile printing of clothes of cotton, silk, wool, chemical fiber, mixed fabric, etc. employs ink jet type printing apparatuses that print patterns and the like on a cloth by discharging inks to a surface of the cloth. A printing apparatus for use in textile printing includes a belt feeder unit that mounts the cloth on an endless belt that has stickiness and thus moves the cloth, in order to use as a recording medium a cloth that has elasticity. In such printing apparatuses, errors occur in the amount of movement of the endless belt due to the eccentricity of a belt driving roller that moves the endless belt and dimensional variations in the thickness direction of the endless belt. Therefore, for example, Japanese Patent No. 5332884 discloses an ink jet recording apparatus (printing apparatus) that performs test printing to determine a corrected amount of feed according to the fed position of a transport belt (endless belt) and corrects the amount of feed of the endless belt to the corrected amount of feed. Japanese Patent No. 5332884 states that this correction makes it possible to control changes in the amount of feed related to the thickness of a joint portion of the endless belt.

When a printing apparatus equipped with an endless belt continuously performs printing on a recording medium, transport error gradually occurs due to slip between the endless belt and the belt driving roller, abrasion of the endless belt, etc. The printing apparatus described in Japanese Patent No. 5332884, while correcting the amount of feed of the endless belt by performing test printing before starting actual printing, does not have a device or the like that detects the transport error that occurs in the continuous printing performed after the test printing.

SUMMARY

An advantage of some aspects of the invention is that printing apparatuses constructed as described below so as to solve at least part of the foregoing problem can be realized.

A printing apparatus according to an aspect of the invention includes a belt mover for an endless belt that transports a recording medium, a feed amount calculator that calculates an amount of feed of the belt mover, a movement amount measurer that measures actual amount of movement of the endless belt by image processing, a compensation table storer that stores a compensation table for compensating a transport error of the endless belt, and a control portion that calculates the amount of feed that is to bring about a predetermined amount of movement of the endless belt by using the feed amount calculator and by referring to the compensation table storer, moves the endless belt by using the belt mover on the basis of the amount of feed, compares the actual amount of movement of the endless belt measured by the movement amount measurer and the predetermined amount of movement, and determines whether a difference greater than or equal to a predetermined value has occurred between the actual amount of movement and the predetermined amount of movement.

Because the printing apparatus according to this aspect includes the movement amount measurer that measures the actual amount of movement of the endless belt, the printing apparatus is able to compare the predetermined amount of movement by which the endless belt is to be moved and the actual amount of movement by which the endless belt actually moves and determine a difference (transport error) between the predetermined amount of movement and the actual amount of movement during a printing operation. Therefore, a transport error that newly occurs during the printing operation can be detected. Note that the term compensate in this specification and the appended claims means to completely or substantially correct or to reduce the transport error (the difference) as well as to compensate the transport error.

In the foregoing printing apparatus, the control portion may notify the notification portion of an alarm if the difference greater than or equal to the predetermined value has occurred.

According to this embodiment, the printing apparatus produces an alarm if a difference (transport error) greater than or equal to the predetermined value occurs between the actual amount of movement and the predetermined amount of movement of the endless belt. This achieves an advantageous effect of preventing the continued printing of an image whose print quality has declined due to a transport error newly produced during a printing operation.

In the foregoing printing apparatus, the control portion may update the compensation table if the difference greater than or equal to the predetermined value has occurred.

According to this embodiment, if a difference (transport error) greater than or equal to the predetermined value occurs between the actual amount of movement and the predetermined amount of movement of the endless belt, the printing apparatus updates the compensation table on the basis of the transport error. This makes it possible to continue printing an image without allowing the print quality to decline.

BRIEF DESCRIPTION OF THE DRAWINGS

The invention will be described with reference to the accompanying drawings, wherein like numbers reference like elements.

FIG. 8 is a second compensation table for compensating the transport error depending on the location of the endless belt.

DESCRIPTION OF EXEMPLARY EMBODIMENTS

Figure 1:
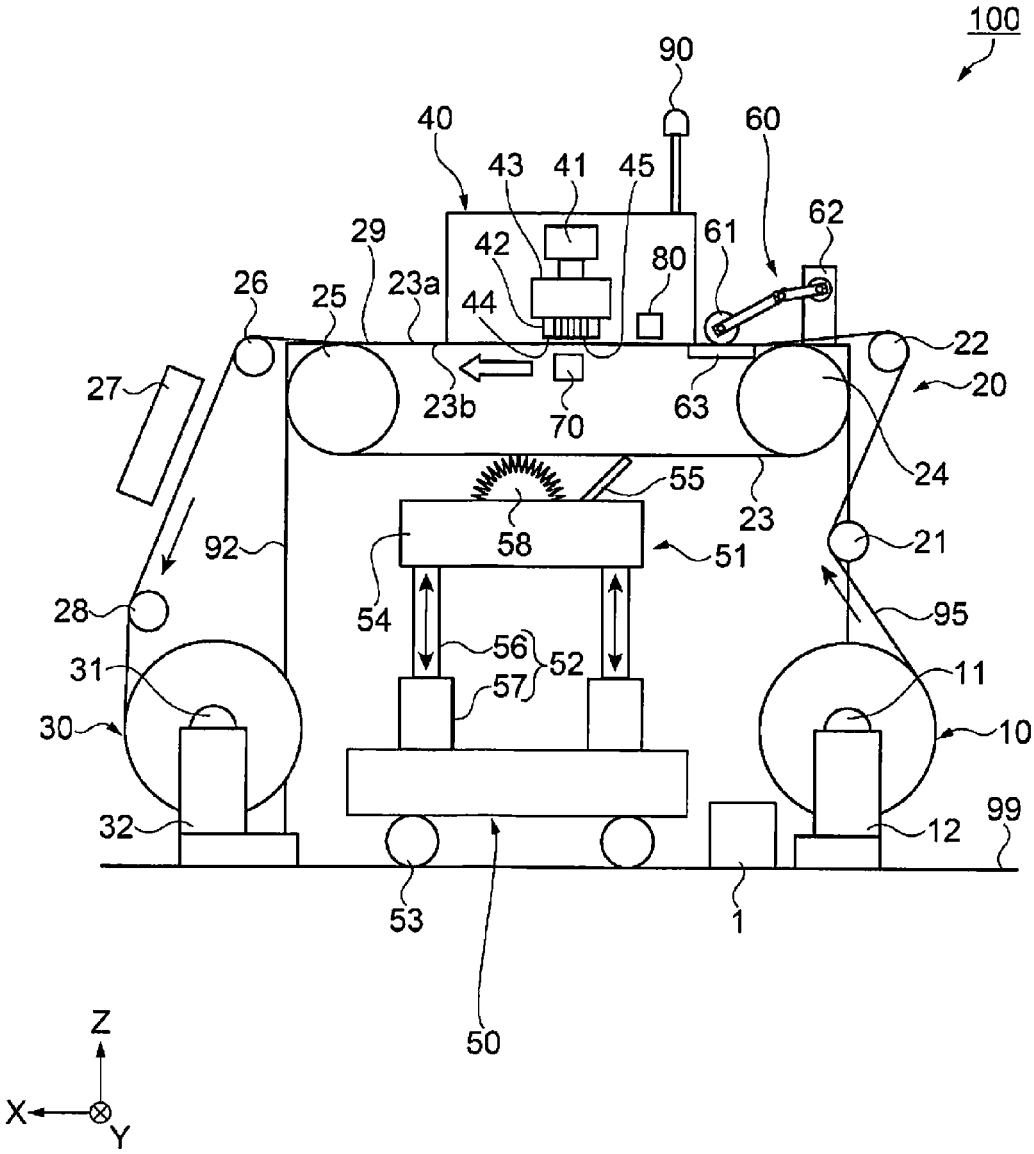
FIG. 1 is a schematic diagram showing a general overall configuration of a printing apparatus according to Exemplary Embodiment 1 of the invention.

Exemplary embodiments of the invention will be described hereinafter with reference to the accompanying drawings. In the drawings referred to below, the size proportions of individual portions and members shown are different from the actual ones so that the portions and members each have a recognizable size.

Furthermore, in FIGS. 1 to 3, FIG. 5, and FIG. 7, for the sake of illustration, an X axis, a Y axis, and a Z axis are indicated as three mutually orthogonal axes each by an arrow whose distal end side is defined as a "plus side" and whose proximal end side is defined as a "minus side". Furthermore, in the following description, the directions parallel to the X axis are termed "X-axis directions", the directions parallel to the Y axis are termed "Y-axis directions", and the directions parallel to the Z axis are termed "Z-axis directions".

Exemplary Embodiment 1

General Configuration of Printing Apparatus

FIG. 1 is a schematic diagram illustrating a general overall configuration of a printing apparatus according to Exemplary Embodiment 1 of the invention. A printing apparatus 100 performs textile printing on a recording medium 95 by forming images and the like on a recording medium 95. As the recording medium 95, a cloth of, for example, cotton, wool, chemical fiber, mixed fabric, etc., is used. This exemplary embodiment will be described in conjunction with a configuration in which an image is formed on the band-shaped recording medium 95 in a roll method but is not limited by this configuration. For example, an image may be formed in a sheet method or the like.

As shown in FIG. 1, the printing apparatus 100 includes a recording medium supply section 10, a recording medium transport section 20, a recording medium collection section 30, a printing section 40, a washing unit 50, a medium close-contact section 60, and a notification portion 90. The printing apparatus 100 also includes a control section 1 that controls these sections and the like. These sections and the like of the printing apparatus 100 are attached to a frame portion 92.

The recording medium supply section 10 supplies the recording medium 95 on which an image is formed, to a printing section 40 side. The recording medium supply section 10 includes a supply shaft portion 11 and a bearing portion 12. The supply shaft portion 11 has a hollow cylindrical shape or a solid cylindrical shape and is provided rotatably in circumferential directions. The band-shaped recording medium 95 has been wound in a roll shape around the supply shaft portion 11. The supply shaft portion 11 is detachably attached to the bearing portion 12. Therefore, the recording medium 95 wound on the supply shaft portion 11 beforehand can be attached together with the supply shaft portion 11 to the bearing portion 12.

The bearing portion 12 supports two ends of the supply shaft portion 11 in its axis direction so that the supply shaft portion 11 is rotatable. The recording medium supply section 10 includes a rotation driving portion (not graphically shown) that rotationally drives the supply shaft portion 11. The rotation driving portion rotates the supply shaft portion 11 in a direction in which the recording medium 95 is fed. Operations of the rotation driving portion are controlled by the control section 1.

The recording medium transport section 20 transports the recording medium 95 from the recording medium supply section 10 to the recording medium collection section 30. The recording medium transport section 20 includes a transport roller 21, another transport roller 22, an endless belt 23, a belt turning roller 24, a belt driving roller 25, still another transport roller 26, a dryer unit 27, and yet another transport roller 28. The transport rollers 21 and 22 relay the recording medium 95 from the recording medium supply section 10 to the endless belt 23.

The endless belt 23 has been formed to be endless by connecting two opposite ends of a band-shaped belt. The endless belt 23 has been wrapped around the belt turning roller 24 and the belt driving roller 25. The endless belt 23 is held with a predetermined tension acting so that portions of the endless belt 23 between the belt turning roller 24 and the belt driving roller 25 are parallel to a floor surface 99. A sticky layer 29 to which the recording medium 95 is caused to adhere is provided on a surface (support surface) 23*a* of the endless belt 23. The endless belt 23 supports (holds) the recording medium 95 that is supplied from the transport roller 22 and that is stuck closely to the sticky layer 29 by the medium close-contact section 60 described later. Therefore, a cloth having elasticity and the like can be handled as a recording medium 95.

The belt turning roller 24 and the belt driving roller 25 support an inner peripheral surface 23*b* of the endless belt 23. A support portion for supporting the endless belt 23 may be provided between the belt turning roller 24 and the belt driving roller 25.

The belt driving roller 25 is a belt mover for the endless belt 23 that transports the recording medium 95. When the belt driving roller 25, as the belt mover, is driven, the rotation of the belt driving roller 25 turns the endless belt 23 and, in turn, the rotation of the endless belt 23 turns the belt turning roller 24. Due to the rotation of the endless belt 23, the recording medium 95 supported by the endless belt 23 is transported in the predetermined transport direction so that an image is formed on the recording medium 95 in the printing section 40 described below. In this exemplary embodiment, the recording medium 95 is supported on a side (plus Z side) where a surface 23*a* of the endless belt 23 faces the printing section 40, and the recording medium 95 is transported together with the endless belt 23 from the belt turning roller 24 side to the belt driving roller 25 side. Furthermore, at the side (minus Z side) where the surface 23*a* of the endless belt 23 faces the washing unit 50, the endless belt 23 alone moves from the belt driving roller 25 side to the belt turning roller 24 side.

The transport roller 26 separates the recording medium 95 having a formed image, from the sticky layer 29 of the endless belt 23. The transport rollers 26 and 28 relay the recording medium 95 from the endless belt 23 to the recording medium collection section 30.

The recording medium collection section 30 collects the recording medium 95 transported by the recording medium transport section 20. The recording medium collection section 30 includes a take-up shaft portion 31 and a bearing portion 32. The take-up shaft portion 31 has a hollow or solid cylindrical shape and is provided rotatably in the circumferential directions. The band-shaped recording medium 95 has been wound in a roll shape on the take-up shaft portion 31. The take-up shaft portion 31 is detachably attached to the bearing portion 32. Therefore, the recording medium 95 wound on the tank-up shaft portion 31 can be detached together with the take-up shaft portion 31.

The bearing portion 32 supports two end portions of the take-up shaft portion 31 in its axis direction so that the take-up shaft portion 31 is rotatable. The recording medium collection section 30 includes a rotation driving portion (not graphically shown) that rotationally drives the take-up shaft portion 31. The rotation driving portion rotates the take-up shaft portion 31 in such a direction that the recording medium 95 is wound around the take-up shaft portion 31. Operations of the rotation driving portion are controlled by the control section 1.

In this exemplary embodiment, the dryer unit 27 is dispose between the transport roller 26 and the transport roller 28. The dryer unit 27 dries the image formed on the recording medium 95. The dryer unit 27 includes, for example, an IR (infrared) heater, and is capable of quickly drying the image formed on the recording medium 95 by activating the IR heater. Therefore, the band-shaped recording medium 95 with an image formed thereon can be wound around the take-up shaft portion 31.

The medium close-contact section 60 brings the recording medium 95 into close contact with the endless belt 23. The medium close-contact section 60 is disposed at an upstream side (the minus X side) of the printing section 40 in the transport direction of the recording medium 95. The medium close-contact section 60 includes a pressing roller 61, a pressing roller driving portion 62, and a roller support portion 63. The pressing roller 61 has a hollow or solid cylindrical shape and is provided rotatably in its circumferential directions. In order to cause the pressing roller 61 to be rotatable in directions along the transport direction, the pressing roller 61 is disposed so that the axis direction of the pressing roller 61 intersects with the transport direction. The roller support portion 63 is provided at the inner peripheral surface 23*b* side of the endless belt 23 so as to face the pressing roller 61 across the endless belt 23.

The pressing roller driving portion 62 moves the pressing roller 61 in the transport direction (plus X-axis direction) and in the direction opposite to the transport direction (which is the minus X-axis direction) while pressing the pressing roller 61 to a downward side in the vertical directions (to the minus Z side). After the recording medium 95 transported from the transport roller 22 is superposed on the endless belt 23, the recording medium 95 is pressed against the endless belt 23 between the pressing roller 61 and the roller support portion 63. Therefore, the recording medium 95 can be certainly stuck to the sticky layer 29 provided on the surface 23*a* of the endless belt 23, so that the recording medium 95 on the endless belt 23 is prevented from lifting off of the surface 23*a*.

The printing section 40 includes an ink jet type discharge head 42 that discharges inks in the form of liquid droplets to the recording medium 95 and a carriage mover 41 that moves the carriage 43 on which the discharge head 42 has been mounted. The printing section 40 is disposed above (at the plus Z side of) the position at which the endless belt 23 has been disposed. The discharge head 42 has a discharge surface 44 in which a plurality of nozzle arrays 45 have been formed. For example, the discharge surface 44 has four nozzle arrays 45 that have been formed so that each of the nozzle arrays 45 discharges an ink whose color (e.g., cyan (C), magenta (M), yellow (Y), or black (K)) is different from those of the inks that the other nozzle arrays 45 discharge. The discharge surface 44 faces the recording medium 95 that is transported by the endless belt 23.

The carriage mover 41 moves the discharge head 42 in directions that intersect with the transport direction of the recording medium 95 (the width directions of the recording medium 95 (Y-axis directions)). The carriage 43 is supported by guide rails (not graphically shown) that are disposed along the Y-axis directions and is movable back and forth in the plus and minus Y-axis directions by the carriage mover 41. The carriage mover 41 employed herein may be, for example, a mechanism that combines a ball screw and a ball nut, a linear guide mechanism, etc.

Furthermore, the carriage mover 41 is provided with a motor (not graphically shown) as a power source for moving the carriage 43 along the Y-axis directions. As the motor is driven, controlled by the control section 1, the discharge head 42 is moved back and forth in the Y-axis directions, together with the carriage 43. Although in the exemplary embodiment, the discharge head 42 is of a serial head type that is mounted on the movable carriage and discharges ink while moving in the width directions of the recording medium 95 (plus and minus Y-axis directions), the discharge head 42 may be of the line head type that is stationarily disposed and extends in the width directions of the recording medium 95 (Y-axis directions).

The printing apparatus 100 includes the washing unit 50 for washing the endless belt 23. More specifically, the washing unit 50 is made up of a washing portion 51, a pressing portion 52, and a movement portion 53. The movement portion 53 is capable of moving the washing unit 50 as an integral unit along the floor surface 99 and fixing the washing unit 50 at a predetermined position. The washing unit 50 is disposed between the belt turning roller 24 and the belt driving roller 25 in the X-axis directions.

The pressing portion 52 is, for example, an elevator apparatus made up of air cylinders 56 and ball bushes 57, and causes the washing portion 51 provided on top of the pressing portion 52 to be movable between a washing position and a withdrawn position. The washing position is a position at which a washing roller 58 and a blade 55 come into contact with the endless belt 23. The withdrawn position is a position at which the washing roller 58 and the blade 55 are apart from the endless belt 23. The washing portion 51, when at the washing position, washes, from below (from the minus Z-axis direction), the surface (support surface) 23*a* of the endless belt 23 wrapped around the belt turning roller 24 and the belt driving roller 25 with a predetermined tension acting. FIG. 1 shows a case where the washing portion 51 has been raised to the washing position.

The washing portion 51 includes a washing tank 54, the washing roller 58, and the blade 55. The washing tank 54 is a tank that holds a washing liquid to be used to wash ink or undesired matters from the surface 23*a* of the endless belt 23. The washing roller 58 and the blade 55 are provided inside the washing tank 54. The washing liquid for use herein may be water or a water-soluble solvent (alcohol aqueous solution or the like) and may also contain a surface-active agent or an antifoaming agent according to need.

A lower-side (minus Z-side) portion of the washing roller 58 is submerged in the washing liquid held in the washing tank 54. When the washing roller 58 rotates at the washing position, the washing liquid is supplied to the surface 23*a* of the endless belt 23 and, at the same time, the washing roller 58 and the endless belt 23 slide against each other. Therefore, ink, fiber of the cloth as the recording medium 95, and the like which have been deposited on the endless belt 23 are removed by the washing roller 58.

The blade 55 may be formed from a flexible material, for example, silicon rubber or the like. The blade 55 is provided at a downstream side of the washing roller 58 in the transport direction of the endless belt 23. As the endless belt 23 and the blade 55 slide against each other, the washing liquid remaining on the surface 23*a* of the endless belt 23 is removed.

The printing apparatus 100 includes the notification portion 90. The notification portion 90 in this exemplary embodiment is, for example, a so-called PATLITE (registered trademark) and, through control by the control section 1, notifies the state of the printing apparatus 100 by a color, a flashing pattern, etc. Incidentally, the notification portion 90 may be a display device made up of a liquid crystal panel or the like and may be caused to display notification contents by characters or graphics.

Figure 2:
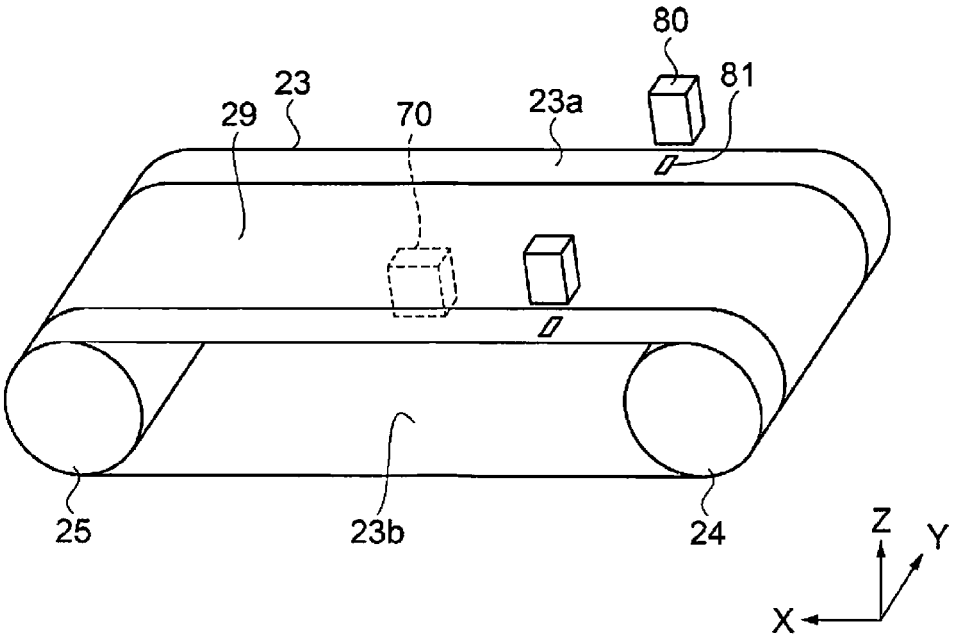
FIG. 2 is an enlarged perspective view of an endless belt.
Figure 3:
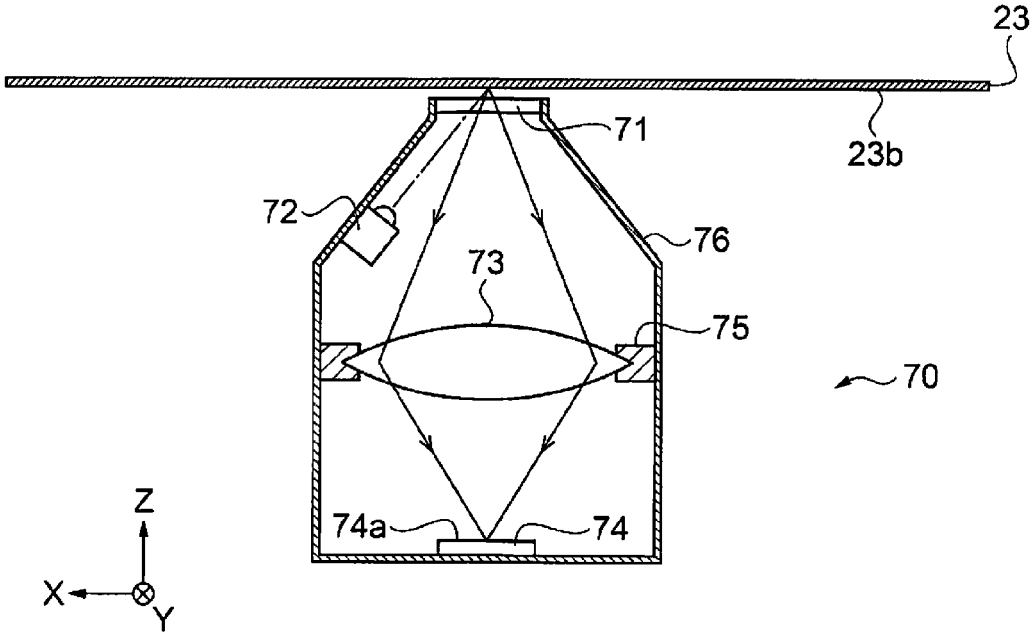
FIG. 3 is a sectional view of a movement amount detection sensor as a movement amount measurer.

FIG. 2 is an enlarged perspective view of the endless belt 23. FIG. 3 is a sectional view of a movement amount detection sensor as a movement amount measurer. Using FIGS. 2 and 3, a movement amount detection sensor 70 and a belt origin sensor 80 that are provided to determine the position and the amount of movement of the endless belt 23 will be described.

The belt origin sensor 80 detects an origin of the endless belt 23. As shown in FIG. 2, markers 81 that indicate an origin of the endless belt 23 are provided in two end portions of the surface 23*a* in the width directions (Y-axis directions) of the endless belt 23 which are not provided with the sticky layer 29. Belt origin sensors 80 are provided vertically upward (at the plus Z side) of the markers 81. When the markers 81, which move as the endless belt 23 moves, pass under the belt origin sensors 80, the belt origin sensors 80 detect the markers 81 and output detection signals.

The movement amount detection sensor 70 is a movement amount measurer that measures the actual amount of movement of the endless belt 23 by image processing. The movement amount detection sensor 70 provided as a movement amount measurer is a sensor for taking images for use for determining the actual amount of movement made by the endless belt 23 by comparing the positions of the endless belt 23 before and after the movement of the endless belt 23. As shown in FIGS. 2 and 3, the movement amount detection sensor 70 is disposed at a position that faces the printing section 40 (see FIG. 1) across the endless belt 23 so as to take images of the inner peripheral surface 23*b* of the endless belt 23.

Although this exemplary embodiment has a configuration in which the movement amount detection sensor 70 is provided facing the inner peripheral surface 23*b* of the endless belt 23, this configuration is not restrictive. The movement amount detection sensor 70 may be provided at such a position as to be able to take images of a portion of the surface 23*a* of the endless belt 23 which is not provided with the sticky layer 29 or the surface of the recording medium 95 mounted on the endless belt 23. It is preferable that the movement amount detection sensor 70 be provided in the vicinity of the printing section 40. Furthermore, in the case where images of the surface 23*a* or the inner peripheral surface 23*b* of the endless belt 23 are to be taken, it is preferable that the surface whose images are to be taken have protuberances and depressions. This allows clear images of the surface to be taken, so that the accuracy of calculation of the amount of movement of the endless belt 23 improves.

As shown in FIG. 3, the movement amount detection sensor 70 has a light emitting portion 72, a condenser lens 73, an image pickup element 74, etc. inside a case 76.

The case 76 forms an exterior of the movement amount detection sensor 70. The case 76 has a shape that combines a truncated cone and a cylinder. A translucent glass pane 71 has been attached to a distal end portion (upper end portion) of the case 76. The translucent glass pane 71 faces the inner peripheral surface 23*b* of the endless belt 23 in the vertical directions with an intervening space.

The light emitting portion 72 emits light toward the endless belt 23. The light emitting portion 72 is provided on an inner wall surface of the case 76 in such an angle posture as to be able to emit light toward the translucent glass pane 71. The light emitting portion 72 may be, for example, a light emitting diode (LED) or the like.

The condenser lens 73 condenses reflected light that is incident within the case 76 after being emitted from the light emitting portion 72, passing through the translucent glass pane 71, reflecting from the inner peripheral surface 23*b* of the endless belt 23, and then passing through the translucent glass pane 71 again. The condenser lens 73 is provided within a cylindrical portion of the case 76.

The image pickup element 74 takes images of the inner peripheral surface 23*b* of the endless belt 23 produced by light condensed by the condenser lens 73. An image pickup surface 74*a* is provided at a position at which images are formed. The image pickup element 74 is provided on an internal bottom surface of the case 76. Incidentally, the condenser lens 73 is held by a holder member 75 at a height such that an image of the inner peripheral surface 23*b* of the endless belt 23 is formed on the image pickup surface 74*a* of the image pickup element 74.

The movement amount detection sensor 70 outputs image data acquired by the image pickup element 74 to the control section 1. The control section 1 compares the image data obtained before and after a movement of the endless belt 23 and calculates the actual amount of movement by which the endless belt 23 has been actually moved.

Next, the transport error of the endless belt 23 will be described.

Figure 4:
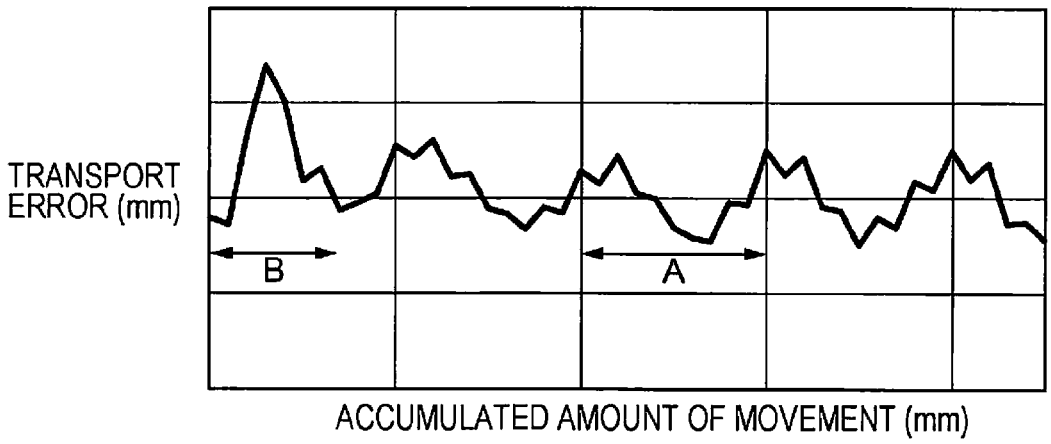
FIG. 4 is a diagram showing an example of a transport error of an endless belt.

FIG. 4 is a diagram showing an example of the transport error of the endless belt 23. In FIG. 4, the horizontal axis represents the accumulated amount of movement obtained when the endless belt 23 is moved repeatedly by a predetermined amount of movement from a predetermined position (e.g., the markers 81) until the endless belt 23 makes one rotation. That is, the maximum value on the horizontal axis in FIG. 4 corresponds to the length of the endless belt 23. The vertical axis in FIG. 4 represents differences between the predetermined amount of movement and the actual amounts of movement calculated from the image data acquired before and after the endless belt 23 is moved by the predetermined amount of movement (the differences will hereinafter be sometimes referred to also as the transport errors).

As shown in FIG. 4, the transport error contains an error appearing periodically at intervals of a stretch A and an error appearing specifically as indicated by a stretch B. The length of the stretch A is substantially equal to the outer circumference of the belt driving roller 25, and it can be understood that the transport error appearing in the stretch A is ascribable to the driving of the belt driving roller 25. The stretch B corresponds to a connecting portion of the endless belt 23, and it can be understood that the transport error appearing in the stretch B is ascribable to the thickness of the endless belt 23. Note that portions of the endless belt 23 other than the connecting portion also produce transport errors ascribable to the thickness of the endless belt 23. Furthermore, when the printing apparatus 100 is continuously operated, the amount of the transport error varies depending on the abrasion of the endless belt 23 caused by the foregoing washing of the endless belt 23, the slip between the endless belt 23 and the belt driving roller 25, etc.

Figure 5:
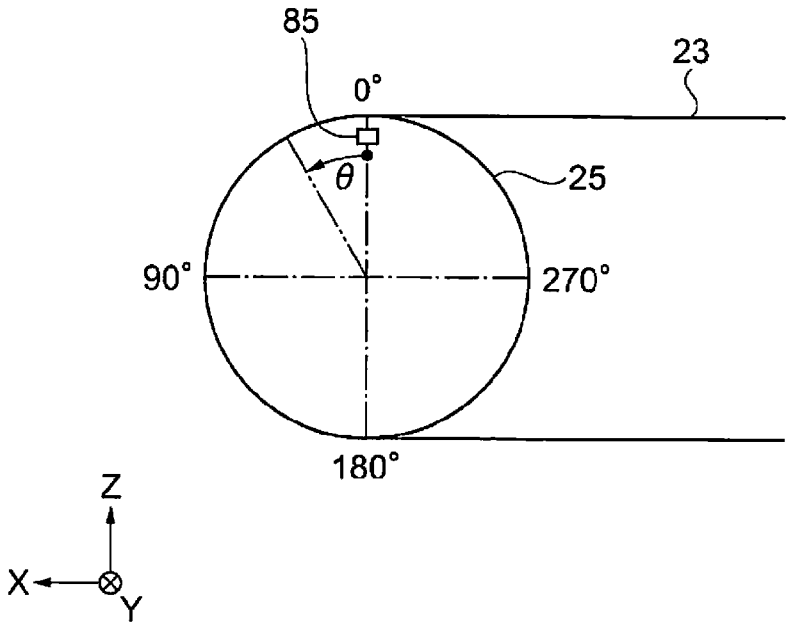
FIG. 5 is a diagram illustrating a drive shaft origin of a belt driving roller as a belt mover.

FIG. 5 is a diagram illustrating the drive shaft origin of the belt driving roller 25 as a belt mover. The belt driving roller 25 is equipped with a drive shaft origin sensor 85. In this description, the position of the drive shaft origin sensor 85 is defined as a reference position of the belt driving roller 25. The drive shaft origin sensor 85 used in this exemplary embodiment may be, for example, a rotary encoder equipped with a marker as the driver shaft origin, or the like. The position of the drive shaft origin moves as the belt driving roller 25 is rotationally driven. In the following description, the position of the drive shaft origin is represented by an angle θ formed by a line connecting the reference position and the center of the belt driving roller 25 and a line connecting the drive shaft origin and the center of the belt driving roller 25.

Figures 6, 7:
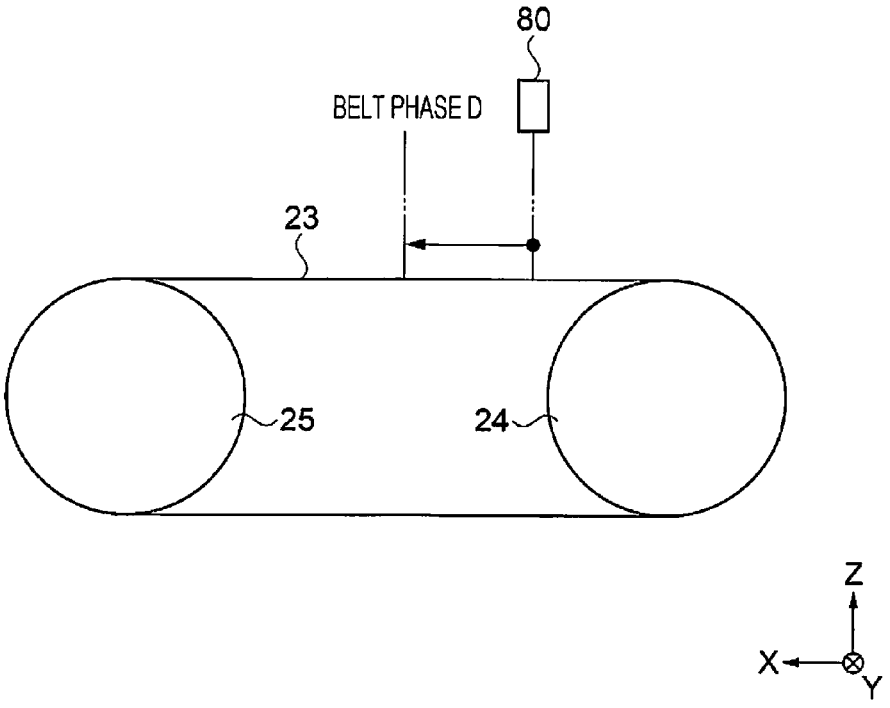
FIG. 6 is a diagram illustrating a first compensation table for compensating the transport error caused by the belt driving roller.
FIG. 7 is a diagram illustrating a belt phase of the endless belt.

FIG. 6 is a diagram showing a first compensation table for compensating the transport error depending on the belt driving roller 25. In the first compensation table shown in FIG. 6, the position of the drive shaft origin of the belt driving roller 25 is indicated by the angle θ as a parameter for the rows of the table and a reference amount of movement Kn that is a predetermined amount of movement is indicated as a parameter for the columns. Furthermore, compensation values α for the amount of movement are indicated at the intersections of the parameters (the angle θ and the reference amount of movement Kn), that is, the intersections of the rows and the columns. The compensation values α can be determined by driving (turning) the belt driving roller 25 successively by an amount of feed equal to the reference amount of movement Kn until the belt driving roller 25 is turned at least 360°. Specifically, at each of the positions (angles θ) of the drive shaft origin of the belt driving roller 25, a compensation value a can be determined by comparing a reference amount of movement Kn and the actual amount of movement by which the endless belt 23 is actually moved when the endless belt 23 is fed by the amount of feed equal to the reference amount of movement Kn.

FIG. 7 is a diagram illustrating belt phase of the endless belt 23. In this illustration, the position of the belt origin sensors 80 is defined as the reference position of the endless belt 23. The markers 81 indicating the origin of the endless belt 23 move in position as the belt driving roller 25 is rotationally driven. In the following description, the position of the markers 81 as the origin of the endless belt 23 will be represented by a belt phase D that is a difference between the position of the markers 81 (the origin) and the position of the belt origin sensors 80 (the reference position).

FIG. 8 is a diagram showing a second compensation table for compensating the transport error depending on the position of the endless belt 23. In the second compensation table shown in FIG. 8, the position of the origin of the endless belt 23 (the markers 81) is indicated by the belt phase D as a parameter for the rows of the table and the reference amount of movement Kn that is a predetermined amount of movement is indicated as a parameter for the columns of the table. Compensation values δ for the amounts of movement are indicated at the intersections of the parameters (the belt phase D and the reference amount of movement Kn), that is, the intersections of the rows and the columns. The compensation values δ can be determined by driving (turning) the belt driving roller 25 successively by an amount of feed equal to the reference amount of movement Kn until the endless belt 23 makes at least one rotation. Specifically, at each of the positions (belt phases D) of the drive shaft origin of the belt driving roller 25, a compensation value δ can be determined by comparing a reference amount of movement Kn and the actual amount of movement by which the endless belt 23 is actually moved when the endless belt 23 is fed by the amount of feed equal to the reference amount of movement Kn.

Incidentally, the compensation values α and the compensation values δ are acquired before the printing apparatus 100 performs a printing operation, and the first compensation table of the compensation values α and the second compensation table of the compensation values δ are stored in a storage portion 5 described later.

Electrical Configuration of Printing Apparatus

Figure 9:
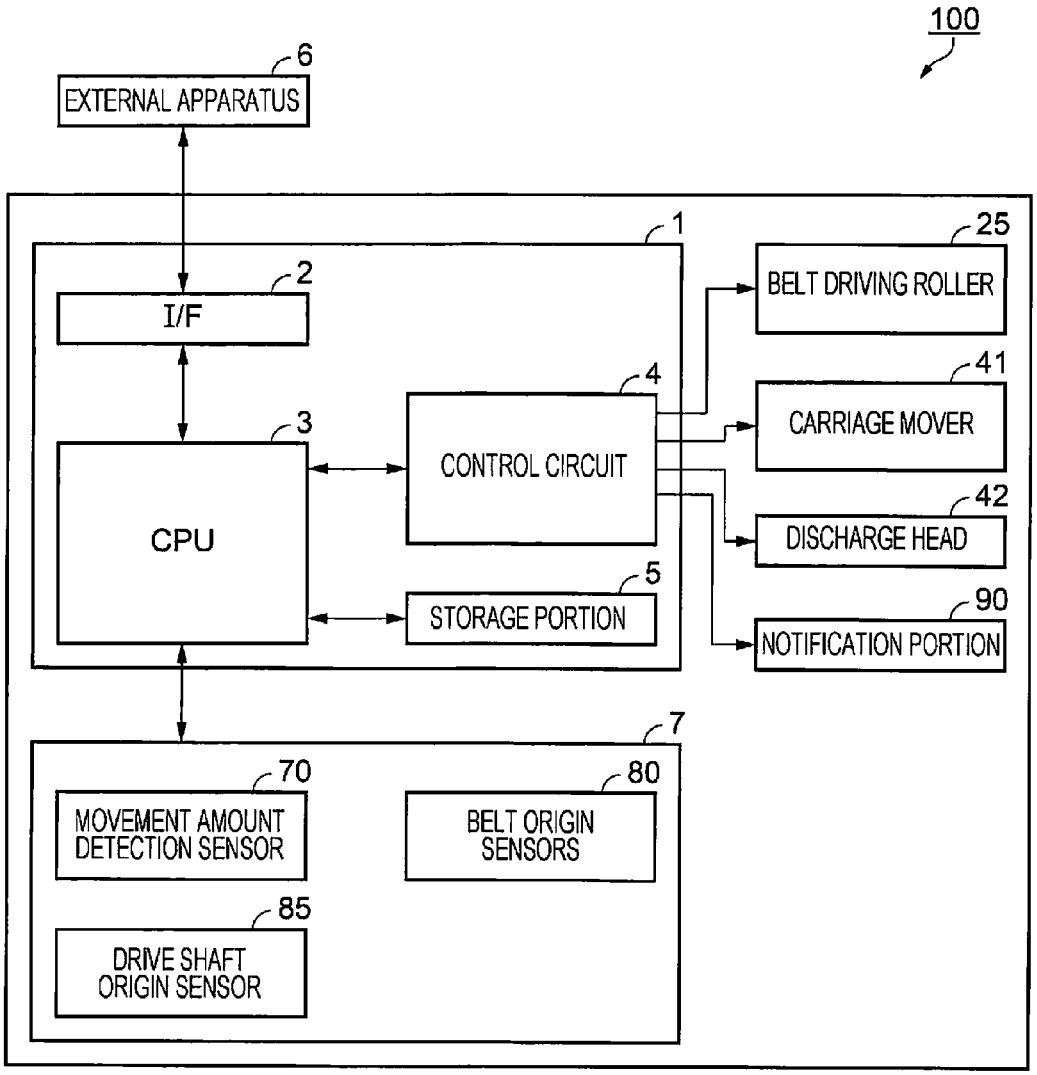
FIG. 9 is an electrical block diagram showing an electrical configuration of a printing apparatus.

FIG. 9 is an electrical block diagram illustrating an electrical configuration of a printing apparatus. An electrical configuration of the printing apparatus 100 will be described with reference to FIG. 9.

The control section 1 is a control unit for controlling the printing apparatus 100. The control section 1 includes a control circuit 4, an interface portion (I/F) 2, a CPU (central processing unit) 3, and a storage portion 5. The interface portion 2 is used to send and receive data between the printing apparatus 100 and an external apparatus 6 that handles images, such as a computer or a digital camera. The CPU 3 is a computation apparatus for performing the processing of signals input from a detector group 7 and overall control of the printing apparatus 100. The detector group 7 includes the movement amount detection sensor 70 as a movement amount measurer for the endless belt 23, the belt origin sensors 80 for the endless belt 23, and the drive shaft origin sensor 85 for the belt driving roller 25.

The storage portion 5 secures a region for storing programs of the CPU 3 and a working region for the CPU 3 and includes storage elements such as a RAM (random access memory) and an EEPROM (electrically erasable programmable read-only memory). The storage portion 5 functions as a compensation table storer that stores compensation tables (the first and second compensation tables) for compensating the transport error of the endless belt 23.

The CPU 3, using the control circuit 4, controls the belt driving roller 25 that moves the endless belt 23 in the transport direction, the carriage mover 41 that moves the carriage 43 on which the discharge head 42 has been mounted in directions that intersect with the transport direction, the discharge head 42 that discharges inks to the recording medium 95, the notification portion 90 that notifies the state of the printing apparatus 100, and other various devices (not graphically shown).

Printing Operation of Printing Apparatus

Figure 10:
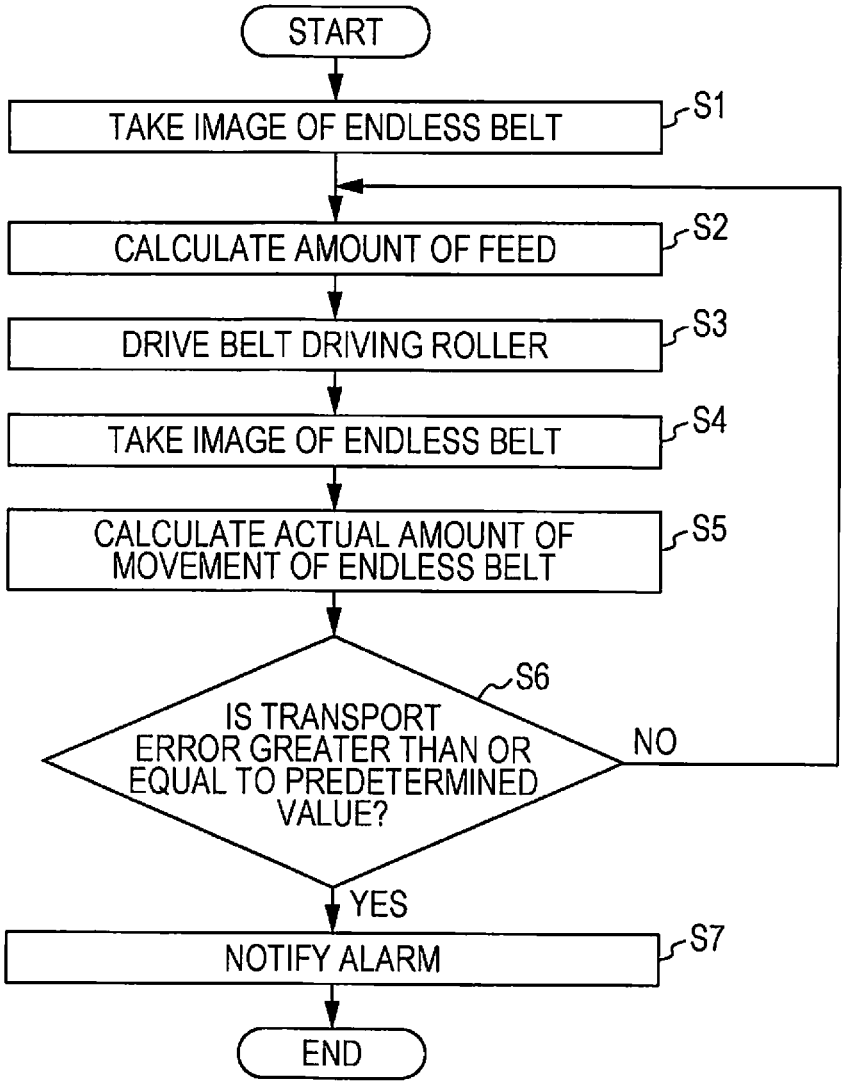
FIG. 10 is a flowchart illustrating a printing operation of a printing apparatus.

FIG. 10 is a flowchart illustrating a printing operation of a printing apparatus. Using FIG. 9 and FIG. 10, a printing operation of the printing apparatus 100 will be described.

In step S1, an image of the endless belt 23 is taken. The CPU 3 controls the movement amount detection sensor 70 as a movement amount measurer so as to take an image of the inner peripheral surface 23*b* of the endless belt 23 prior to a movement of the endless belt 23 and stores the acquired image data into the storage portion 5.

In step S2, the amount of feed of the belt driving roller 25 is calculated. The control section 1 (CPU 3) calculates the amount of feed that brings about a predetermined amount of movement (reference amount of movement Kn) of the endless belt 23 by referring to the storage portion 5 as the compensation table storer. Specifically, the CPU 3 receives signals from the belt origin sensors 80 and the drive shaft origin sensor 85 and calculates the position (angle θ) of the origin of the belt driving roller 25 and the position (belt phase D) of the origin of the endless belt 23. Then, the CPU 3 refers to the first and second compensation tables stored in the storage portion 5 to calculate the amount of feed-out of the belt driving roller 25. The amount of feed-out is a value obtained by adding the compensation value a determined from the angle θ and the reference amount of movement Kn and the compensation value δ determined from the belt phase D and the reference amount of movement Kn to the reference amount of movement Kn. Incidentally, the operation of step S2 corresponds to a feed amount calculator that calculates the amount of feed of the belt driving roller 25 as a belt mover.

In step S3, the belt driving roller 25 is driven. The control section 1 moves the endless belt 23 by using the belt driving roller 25 as a belt mover. The control section 1 controls the belt driving roller 25 so that the belt driving roller 25 is driven by the amount of feed calculated in step S2 to move the endless belt 23. As a result, the recording medium 95 mounted on the endless belt 23 is transported in the transport direction.

In step S4, an image of the endless belt 23 is taken. The CPU 3 controls the movement amount detection sensor 70 so as to take an image of the inner peripheral surface 23*b* of the endless belt 23 after the movement and then stores the image into the storage portion 5. Furthermore, the control section 1 controls the carriage mover 41 and the discharge head 42 so as to discharge inks from the discharge head 42 to the recording medium 95 while moving the carriage 43 in the direction that intersects with the transport direction of the recording medium 95.

In step S5, the actual amount of movement of the endless belt 23 is calculated. The control section 1 (CPU 3) calculates the actual amount of movement of the endless belt 23 measured by the movement amount detection sensor 70 as a movement amount measurer. Specifically, the control section 1 calculates the actual amount of movement by which the endless belt 23 was actually moved, from the pre-movement and post-movement image data of the endless belt 23 acquired and stored in the storage portion 5 in steps S1 and S4, respectively.

In step S6, it is determined whether the transport error of the endless belt 23 is greater than or equal to a predetermined value. The control section 1 (CPU 3) compares the actual amount of movement of the endless belt 23 calculated in step S5 and the predetermined amount of movement (reference amount of movement Kn) and determines whether there has occurred a difference therebetween that is greater than or equal to the predetermined value stored in the storage portion 5. Note that the difference determined in this step is a transport error newly produced by the continuous printing operation. If this transport error is less than the predetermined value (NO in step S6), the printing operation of the printing apparatus 100 goes back to step S2 and the process of steps S2 to S6 is repeated. Therefore, a stable image with high print quality is formed on the recording medium 95. If the transport error is greater than or equal to predetermined value (YES in step S6), the control section 1 notifies an alarm to the notification portion 90 and stops the operation of the printing apparatus 100. This operation prevents continued production of a product whose print quality has declined because of a transport error having occurred during the printing operation. Furthermore, due to this operation of the printing apparatus 100, a transport error that newly occurs during printing can be detected.

As stated above, the printing apparatus 100 according to this exemplary embodiment can achieve the following advantageous effects.

The printing apparatus 100 includes the movement amount detection sensor 70 that takes images of the inner peripheral surface 23*b* of the endless belt 23 as a movement amount measurer. The control section 1 is able to measure the actual amount of movement of the endless belt 23 by comparing the image data acquired by the movement amount detection sensor 70 before and after the movement of the endless belt 23. Furthermore, by comparing a predetermined amount of movement (reference amount of movement Kn) by which the endless belt 23 is to be moved and the actual amount of movement of the endless belt 23, the control section 1 is able to detect a transport error that newly occurs during the printing operation of the printing apparatus 100. Furthermore, if the transport error becomes greater than or equal to the predetermined value during a printing operation, the control section 1 notifies an alarm to the notification portion 90 and stops the printing operation of the printing apparatus 100. Therefore, the continued printing of an image with reduced print quality can be prevented. Therefore, the printing apparatus 100 whose image quality is high and stable can be provided.

Exemplary Embodiment 2

Figure 11:
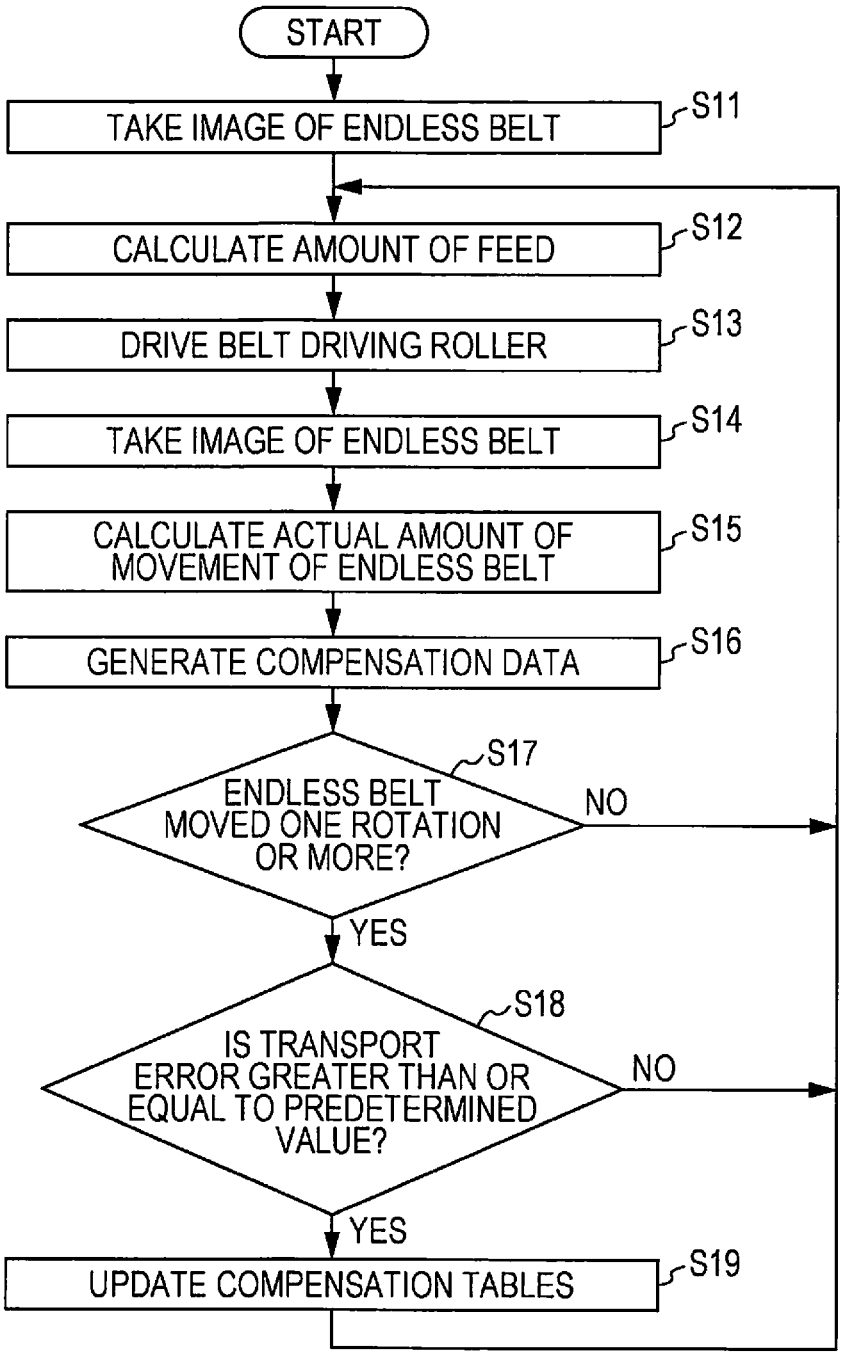
FIG. 11 is a flowchart illustrating a printing operation of a printing apparatus according to Exemplary Embodiment 2.

FIG. 11 is a flowchart illustrating a printing operation of a printing apparatus according to Exemplary Embodiment 2. With reference to FIG. 9 and FIG. 11, the printing operation of the printing apparatus 100 will be described. In the flowchart shown in FIG. 11, steps S11 to S15 are the same processes as steps S1 to S5 in the flowchart shown in FIG. 10 in conjunction with Exemplary Embodiment 1. Description of these steps will be omitted below.

In step S16, compensation data is generated. The CPU 3 compares the actual amount of movement calculated in step S15 and the reference amount of movement Kn to calculate a transport error that has newly occurred and, on the basis of the calculated transport error, generates at least one of a compensation value a and a compensation value δ. The CPU 3 accumulates the at least one generated compensation value as new compensation data (the compensation value a and/or the compensation value δ) in the storage portion 5.

In step S17, it is determined whether the endless belt 23 has made one rotation or more. If the total amount of movement of the endless belt 23 is less than one rotation (NO in step S17), the printing operation of the printing apparatus 100 goes back to step S12 and the process of steps S12 to S17 is repeated. If the total amount of movement of the endless belt 23 is greater than or equal to one rotation (YES in step S17), the operation proceeds to step S18. Note that when the amount of movement of the endless belt 23 becomes greater than or equal to one rotation, the compensation data newly generated in step S16 complete the new generation of compensation tables (first and second compensation tables) for one rotation of the endless belt 23.

In step S18, it is determined whether the transport error of the endless belt 23 is greater than or equal to a predetermined value. The control section 1 (CPU 3) compares the actual amount of movement of the endless belt 23 calculated in step S15 and the predetermined amount of movement (reference amount of movement Kn) and determines whether a difference (transport error) greater than or equal to a predetermined value stored in the storage portion 5 has occurred between the actual amount of movement and the predetermined amount of movement (reference amount of movement Kn). If the transport error is less than the predetermined value (NO in step S18), the printing operation of the printing apparatus 100 goes back to step S12 and the process of steps S12 to S18 is repeated. If the transport error is greater than or equal to the predetermined value (YES in step S18), the operation proceeds to step S19.

In step S19, the compensation tables are updated. The control section 1 replaces the compensation tables (the first and second compensation tables) to which the control section 1 has been referring with the compensation tables newly generated by accumulating the compensation data generated in step S16. Then, the printing apparatus 100 repeats the process of steps S12 to S19 until the printing operation is stopped. This makes it possible to continue printing images on the recording medium 95 without allowing the print quality to decline.

As stated above, the printing apparatus 100 according to this exemplary embodiment can achieve the following advantageous effects.

The printing apparatus 100 accumulates compensation data that reflect a transport error newly produced during a printing operation to generate new compensation tables (first and second compensation tables). If the transport error becomes greater than or equal to the predetermined value during a printing operation, the control section 1 updates the compensation tables to which the control section 1 has been referring to the newly generated compensation tables, so that printing with high and stable image quality can be continued.

Incidentally, the invention is not limited to the foregoing exemplary embodiments but various changes and improvements can be added to the foregoing exemplary embodiments. Modifications of the exemplary embodiments will be described below.

Modifications

Figure 12:
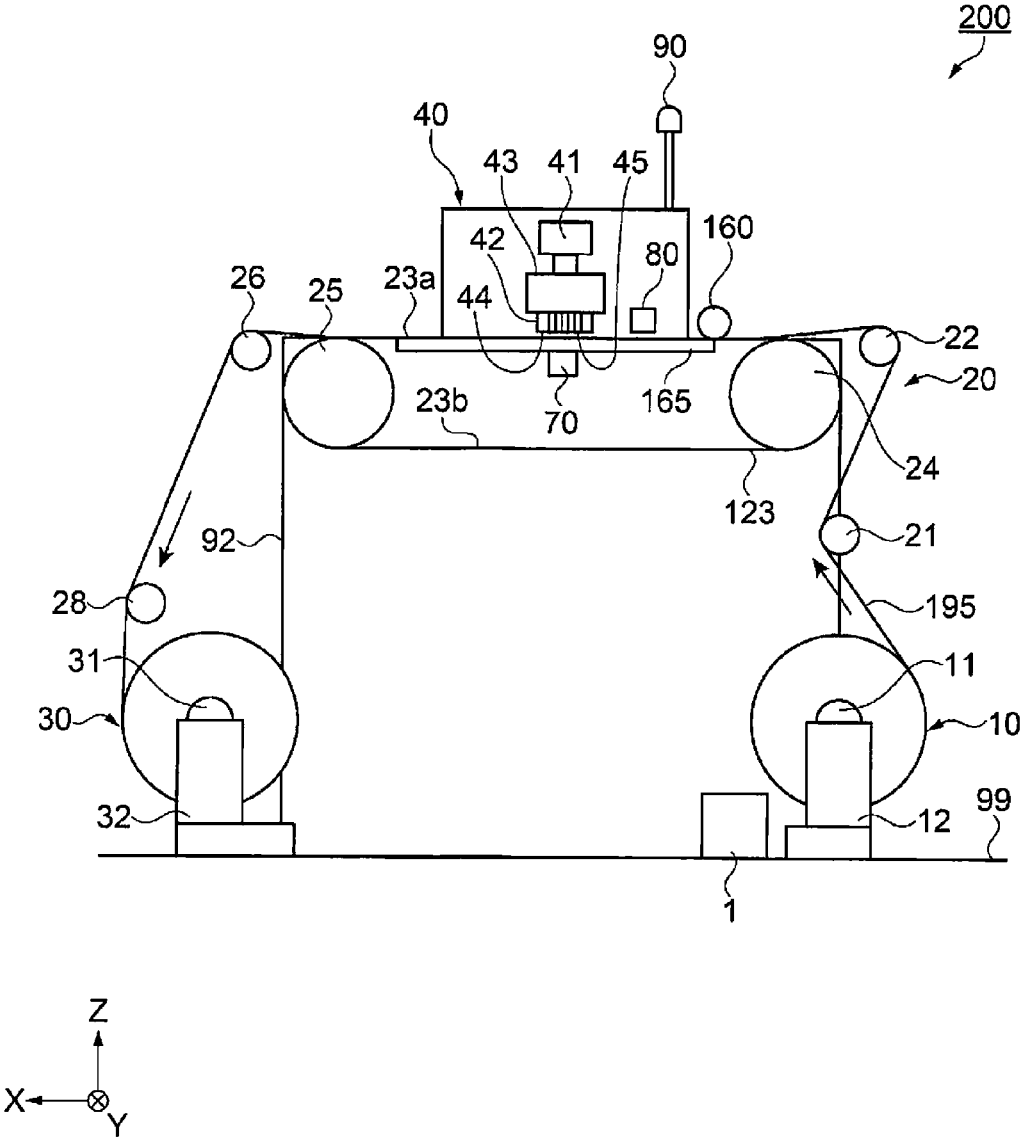
FIG. 12 is a schematic diagram showing a general overall configuration of a printing apparatus according to a modification.

FIG. 12 is a schematic diagram illustrating a general overall configuration of a printing apparatus according to a modification of the foregoing exemplary embodiments.

Although in Exemplary Embodiments 1 and 2 described above, the endless belt 23 is provided with the sticky layer 29 and a cloth is used as the recording medium 95, this arrangement does not limit the invention.

Hereinafter, a printing apparatus 200 according to a modification will be described. Note that substantially the same portions and the like as those in Exemplary Embodiment 1 are given the same reference numerals and redundant descriptions are omitted below.

An endless belt 123 has been formed to be endless by connecting two opposite ends of a band-shaped belt. The endless belt 123 has been wrapped around a belt turning roller 24 and a belt driving roller 25. The endless belt 123 is held with a predetermined tension acting so that portions of the endless belt 123 between the belt turning roller 24 and the belt driving roller 25 are parallel to a floor surface 99. The endless belt 123 is made of a flexible material.

A platen 165 that extends in a transport direction (X-axis direction) is provided at a position that faces a printing section 40 across the endless belt 123. The platen 165 contains electrodes (not graphically shown). At an upstream end of the platen 165 there is provided a nip roller 160 that presses a recording medium 195 against the endless belt 123 after the recording medium 195 has been transported from a transport roller 22 and superposed on the endless belt 123. When a voltage is applied to the electrodes contained in the platen 165, the recording medium 195 is electrostatically attached to the endless belt 123 and thereby transported in the transport direction. Therefore, the recording medium 195, such as paper, can be transported by the endless belt 123.

Application of the printing operations illustrated above in conjunction with Exemplary Embodiments 1 and 2 to the printing apparatus 200 will achieve substantially the same advantageous effects as stated above.

This application claims priority under 35 U.S.C. §119 to Japanese Patent Application No. 2015-138482, filed Jul. 10 2015. The entire disclosure of Japanese Patent Application No. 2015-138482 is hereby incorporated herein by reference.

What is claimed is:

1. A printing apparatus comprising:

a belt mover for an endless belt that transports a recording medium;

a feed amount calculator that calculates an amount of feed of the belt mover;

a movement amount measurer that measures actual amount of movement of the endless belt by image processing;

a compensation table storer that stores a compensation table for compensating a transport error of the endless belt; and a control portion that calculates the amount of feed that is to bring about a predetermined amount of movement of the endless belt by using the feed amount calculator and by referring to the compensation table storer, moves the endless belt by using the belt mover on the basis of the amount of feed, compares the actual amount of movement of the endless belt measured by the movement amount measurer and the predetermined amount of movement, and determines whether a difference greater than or equal to a predetermined value has occurred between the actual amount of movement and the predetermined amount of movement.

2. The printing apparatus according to claim 1, further comprising a notification portion, wherein the control portion notifies the notification portion of an alarm if the difference greater than or equal to the predetermined value has occurred.

3. The printing apparatus according to claim 1, wherein the control portion updates the compensation table if the difference greater than or equal to the predetermined value has occurred.

* * * * *